US009891026B2

(12) United States Patent
Dalgic et al.

(10) Patent No.: US 9,891,026 B2
(45) Date of Patent: Feb. 13, 2018

(54) ACCESS HATCH FOR AN UNMANNED TURRET OF AN ARMORED VEHICLE

(71) Applicant: Cockerill Maintenance & Ingenierie S. A., Seraing (BE)

(72) Inventors: Oktay Dalgic, Gosselies (BE); Riadh Haj Ayed, Brussels (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 15/514,565

(22) PCT Filed: Sep. 25, 2015

(86) PCT No.: PCT/EP2015/072174

§ 371 (c)(1),
(2) Date: Mar. 27, 2017

(87) PCT Pub. No.: WO2016/050653

PCT Pub. Date: Apr. 7, 2016

(65) Prior Publication Data

US 2017/0227335 A1 Aug. 10, 2017

(30) Foreign Application Priority Data

Sep. 29, 2014 (BE) ..... 2014/0725

(51) Int. Cl.

| | |
|---|---|
| ***F41A 23/24*** | (2006.01) |
| ***F41H 5/22*** | (2006.01) |
| ***F41H 5/20*** | (2006.01) |
| ***F41H 7/04*** | (2006.01) |

(52) U.S. Cl.
CPC ..... *F41H 5/223* (2013.01); *F41H 5/20* (2013.01); *F41H 7/04* (2013.01)

(58) Field of Classification Search
CPC ..... F41H 7/005; F41H 7/02; F41H 7/04
USPC ..... 89/36.13, 36.08, 36.09
See application file for complete search history.

(56) References Cited

U.S. PATENT DOCUMENTS

| | | | | |
|---|---|---|---|---|
| 3,566,742 A | | 3/1971 | Bemiss | |
| 4,524,674 A | * | 6/1985 | Gilvydis | F41H 7/04 89/36.08 |
| 8,726,783 B2 | * | 5/2014 | Berkovich | F41H 5/20 89/36.13 |

(Continued)

FOREIGN PATENT DOCUMENTS

| | | |
|---|---|---|
| BE | 633101 A | 10/1963 |
| DE | 3121143 A1 | 9/1990 |

(Continued)

*Primary Examiner* — J Woodow Eldred
(74) *Attorney, Agent, or Firm* — Leydig, Voit & Mayer, Ltd.

(57) ABSTRACT

An armored vehicle, or battle tank, has a turret, the backplane of which has a hatch allowing access to an inner volume of the turret from the inner volume of the vehicle body. The access hatch has a rectangular-shaped opening and includes a plate for closing up the opening in the form of a plurality of sectors able first to slide in a translational movement in a horizontal movement section and next to be stacked on one another in a vertical stacking section, during the opening of the hatch, the sections being located superimposed in or above the backplane. The access hatch sectors and the backplane include ballistic protection in the form of a metal armor plate covered with an anti-spall coating.

12 Claims, 4 Drawing Sheets

(56) References Cited

U.S. PATENT DOCUMENTS

| | | | | |
|---|---|---|---|---|
| 8,759,268 | B2 * | 6/2014 | Nakamura | C11D 7/265 510/175 |
| 9,464,856 | B2 * | 10/2016 | Lung | F41A 9/29 |
| 2011/0219944 | A1 | 9/2011 | Adorni et al. | |
| 2014/0230640 | A1 * | 8/2014 | Chu | F41H 5/223 89/36.08 |

FOREIGN PATENT DOCUMENTS

| | | | |
|---|---|---|---|
| EP | 1061323 | B1 | 12/2000 |
| EP | 0844455 | B1 | 6/2001 |
| EP | 1508765 | B1 | 2/2005 |
| EP | 2157395 | A2 | 2/2010 |
| EP | 2354749 | B1 | 8/2011 |
| FR | 2885854 | A1 | 11/2006 |
| WO | 2012063235 | A1 | 5/2012 |

* cited by examiner

ACCESS HATCH FOR AN UNMANNED TURRET OF AN ARMORED VEHICLE

CROSS-REFERENCE TO RELATED APPLICATIONS

This application is a U.S. national stage application under 35 U.S.C. § 371 of International Application No. PCT/EP2015/072174, filed on Sep. 25, 2015, and claims benefit to Belgian Patent Application No. 2014/0725, filed on Sep. 29, 2014. The International Application was published in French on Apr. 7, 2016, as WO 2016/050653 A1 under PCT Article 21(2).

FIELD

The present invention falls within the technical field of unmanned or remotely-operated turrets equipped with a medium or large caliber cannon intended for armored vehicles or battle tanks.

BACKGROUND

It is known that armored vehicles or battle tanks with an unmanned turret may have a system for accessing the turret situated between the vehicle and the turret.

There are at least four types of primary needs relative to access to the turret, i.e., the respective needs:

- for operational reasons, such as loading ammunition, access to the travel lock (which locks the turret during transport), to the radio, etc.
- for maintenance reasons;
- for backup reasons during a mission (or manual or degraded operation in case of power failure);
- for safety reasons, in particular to provide for the evacuation of the crew of the vehicle via the turret.

Currently, either the turret is not accessible from the vehicle, or there is still access, generally via a pivoting hatch, for example mounted on hinges, which inevitably opens either toward the outside of the vehicle body, i.e., toward the turret, thus creating a bulk in the inner volume thereof that hinders access to the equipment located in the turret, or toward the inside of the vehicle body, which imposes an intrusion into that body.

Patent BE 633101 A discloses an unmanned turret, capable of rotating relative to its vertical axis, with an automatic-weapon carriage and an unmanned dome capable of receiving gunners, ammunition, etc. and which has an opening that can be closed by a flap, i.e., a hatch for communication with the dome.

Patent EP 844 455 B1 discloses an armored combat vehicle, in which an unoccupied turret is arranged on the upper face of the vehicle body, by means of a rotating ring arranged in the roof plate of the vehicle, with the particularity that the turret does not enter the vehicle body and is capable of housing an automatic large-caliber cannon of up to 50 mm.

Patent EP 1 061 323 B1 discloses an armored transport motor vehicle, characterized in that the gun carriage is formed by an unmanned flat gun-port turret and in that the gun carriage and the automatic onboard weapon are made so as to be able to be remotely controlled from inside the vehicle, the electricity and the electrical signals necessary for the remote control being transmitted to the turret by means of a collecting ring (called "the slipring"). The turret does not enter the vehicle, with the exception of part of the slipring. The turret can rotate relative to the vehicle owing to a circumferential rolling bearing. In the turret are located the base components such as the automatic cannon, the ammunition magazine, the cabling, the machine gun, the strip collector, the lenses, etc. No communication hatch between the vehicle and the turret is expressly provided.

U.S. Pat. No. 3,566,742 A discloses an armored transport vehicle, characterized in that it has an opening on the metal sheet of the roof, capable of adapting several types of weaponry via an interface plate designed based on needs. One of the possibilities of this invention is to be able to install, on the vehicle, an unmanned turret with an automatic cannon and a machine gun via an interface plate that completely closes the base of the turret (without introducing the turret into the vehicle). The patent suggests that, in that interface plate, two access hatches can be installed, i.e., pivoting hatches fastened by hinges.

Patent EP 1 508 765 B1 discloses a modular weaponry station intended to be placed on a combat vehicle, containing a primary weapon and a secondary weapon, which are controlled from outside the station, that is to say that they are remotely operated. The turret rotates relative to the vertical axis using a live ring and is mounted on the metal sheet of the roof of the vehicle. The passage between the vehicle and the station is ensured by an access hatch.

Document WO 2012/063235 A1 discloses a turret assembly, without platform penetration, to reduce the exposure of combatants to enemy forces when the latter access above the platform equipment, comprising:

- a base plate on which is mounted at least one piece of fireable and remotely operable interfaceable combatant equipment, the base plate being able to rotate around a substantially vertical axis and supported for rotation by a bearing means mounted inside a platform of a military facility;
- a pivoting hatch connected to the base plate, to normally cover a hatch arranged in said base plate and to expose the hatch when the plate is moved; and
- a rotatable disc of a slipring unit carried by the hatch, by which electricity to actuate the equipment mounted on top of the platform and to initiate control signals is transmitted to the equipment.

Patent EP 2 354 749 B1 proposes a solution in the form of intrusion means via the vehicle, which do not cover a large surface area. A base of the turret is mounted rotating on the armored cockpit of the vehicle, via a circumferential fifth wheel. This patent discloses the presence of a rectangular armored hatch between the turret and the cockpit of the vehicle in order to allow communication between both areas. In that case, the hatch opens downwardly. It is mounted pivoting on the base of the turret via a pair of opposed hinges.

This system has the following drawbacks:

- its shape: rectangular with smaller dimensions, which limits the passage and makes it difficult;
- its position: at the back of the turret, which only allows access to the ammunition magazine and not to the cannon;
- the intrusion in the vehicle: compliance with the standard, but does not allow any movement and only allows individual visit. The hatch, opened toward the inside of the vehicle, does not ensure the safety of the crew if the turret is rotated (in manual or electric mode), and does not make it possible to rotate the turret in manual mode in the opening position of the hatch;
- when the hatch is closed, the handle is inside the cockpit of the vehicle;

the presence of hinges: constitutes a possible danger, since from a safety perspective for the crew, the intrusion of the handle on the vehicle side may cause accidents with respect to the crew and the hinges may also constitute a danger upon explosion of a mine that could turn the hatch or its components into a threatening projectile;

access to the turret: it does not meet operational ergonomic needs. In light of the position, shape and size of the hatch, it is not possible to access the cannon easily during an ammunition blockage.

The other hatches typically found in the state of the art (see in particular the documents cited above) have the same shape, are often square or rectangular and always mounted pivoting on hinges and with smaller dimensions for the passage of a person, which is therefore limited to a well-defined position of the body.

Document WO 2012/063235 A1 discloses a turret assembly in a combat vehicle having a rotating base plate on which a piece of remotely-controlled firing equipment is mounted, said base plate comprising a communication hatch with the vehicle. Different hatch systems are described: pivoting vertically with hinges or horizontally with pivot, with an opening parallel to the hatch.

Document EP 2 157 395 A2 discloses an additional hatch-covering system on a combat vehicle in order to ensure the protection of persons against jamming in the hatch when the latter closes electrically. This covering device comprises a certain number of elements or sectors moving relative to one another. In the open position, these elements are positioned above one another and to obtain the closed position, they are moved relative to one another such that each one covers part of the opening of the hatch. This principle is in particular illustrated by the case of sickle-shaped sectors that slide on one another around a pivot with a vertical axis, the sectors being connected to one another by a slot and lug coupling system. This type of light and fragile covering system is not intended to replace the armor or sealing plate of the hatch, but rather the rolling blind or flap for additional protection used thus far. It is only when the additional protection flap or system is completely deployed in the closing position that the electric closing system for the armored hatch is activated, completely safely for the occupants of the armored vehicle.

SUMMARY

An aspect of the invention provides an armored vehicle or battle tank, comprising: a vehicle body; and a turret mounted so as to be rotatable along a substantially vertical axis on the vehicle body using a circumferential rolling bearing. The turret includes a base in a form of a backplane, connected to the vehicle body by the circumferential rolling bearing. The backplane includes a collecting ring in a form of a slipring, configured to convey energy and electric signals to control the turret. The backplane includes an access hatch mounted slidingly in the backplane and allowing access to an inner volume of the turret from an inner volume of the vehicle body. The access hatch has a rectangular-shaped opening and includes a plate configured to close up the rectangular-shaped opening, the plate having a form of a plurality of sectors able first to slide in a translational movement in a horizontal movement section and able to be stacked on one another in a vertical stacking section. During opening of the hatch, the sections are located superimposed in or above the backplane. The access hatch sectors and the backplane include ballistic protection in a form of a metal armor plate covered with an anti-spall coating.

BRIEF DESCRIPTION OF THE FIGURES

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIGS. 5A-5E diagrammatically, part(s) of the closing sequence of the hatch according to FIGS. 2 to 4.

DETAILED DESCRIPTION

Figure 1:
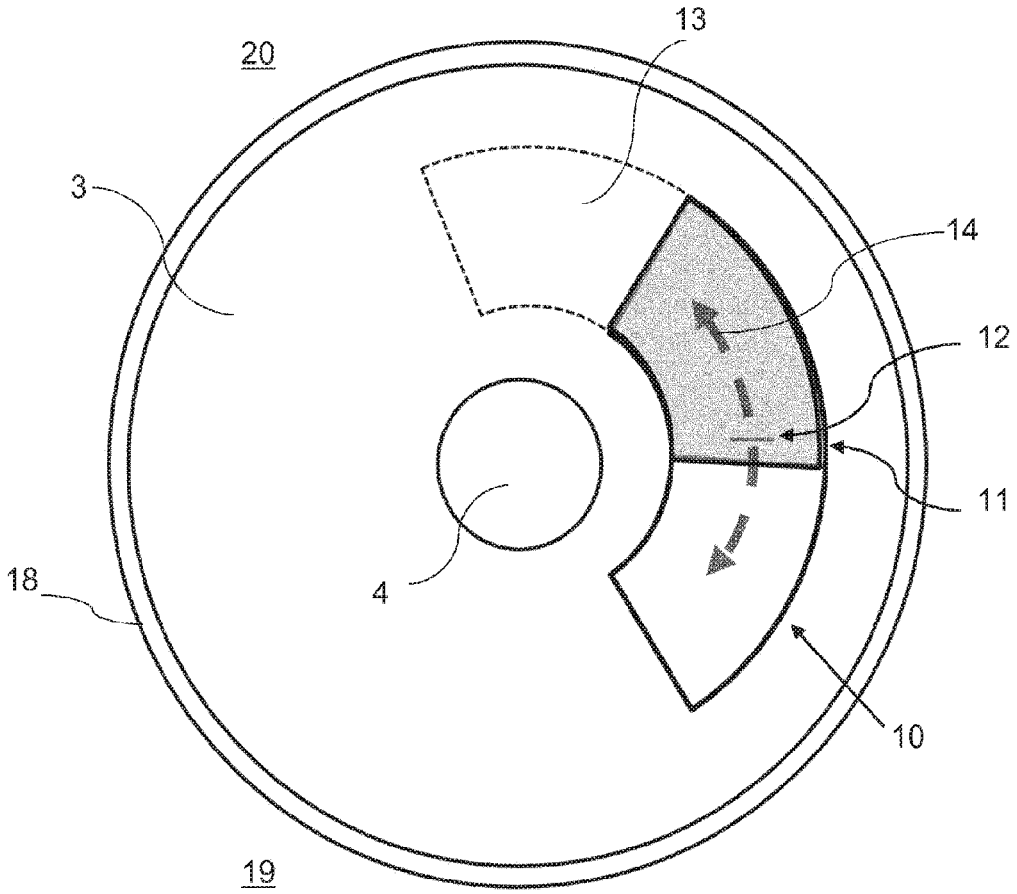
FIG. 1 diagrammatically, a planar view (seen from above) of a first embodiment of the invention having an access hatch in the form of a sliding circular sector, wherein the hatch is partially open.

An aspect of the present invention provides one or more unmanned or remotely-operated turrets equipped with a medium or large caliber cannon intended for armored vehicles or battle tanks. In an embodiment, the invention provides a system for accessing an unmanned turret, from the vehicle body, for operational, maintenance, or backup needs.

An aspect of the present invention provides a solution intended to obtain greater coverage of the access space to the inside of the turret as well as more ergonomic access to the key components of and in the turret and offering greater safety for personnel during that access.

More particularly, an aspect of the invention improves the ergonomics of the workspace, which is ideally reflected by access at an angle of at least 90 degrees to the turret, which makes it possible to facilitate access to the various equipment of the turret such as the ammunition magazine, the cannon, the radio, etc. in complete safety for the crew.

Still more particularly, in an aspect of the invention, the selected hatch system has a design not allowing any intrusion into said turret or posing a threat for the crew in case of explosion of a mine.

An aspect of the present invention relates to an armored vehicle or battle tank, comprising a vehicle body and a turret, mounted rotating along a substantially vertical axis on said vehicle body by means of a circumferential rolling bearing, said turret comprising a base, called the backplane, connected to said vehicle body by the circumferential rolling bearing and provided with a collecting ring, commonly called the slipring, bringing the energy and electric signals necessary to control the turret, said backplane comprising an access hatch mounted sliding in the backplane and allowing access to an inner volume of the turret from the inner volume of the vehicle body, characterized in that:

the access hatch has a rectangular-shaped opening and comprises a plate for closing up the opening in the form of a plurality of sectors able first to slide in a translational movement in a horizontal movement section and to be next stacked on one another in a vertical stacking section, during the opening of the hatch, said sections being located superimposed in or above the backplane;

the access hatch sectors and the backplane are both provided with ballistic protection in the form of a metal armor plate covered with an anti-spall coating.

According to preferred embodiments of the invention, the armored vehicle also comprises one, or an appropriate combination, of the following features:

the access hatch comprises guides provided with grooves belonging to the horizontal section, in which the sectors slide, and to the vertical section, in which the sectors are stacked on one another, the sectors being provided with rollers cooperating with the grooves of the guides to ensure the movement of the sectors in the horizontal section and in the vertical section, respectively;

the vertical section is provided with a device that exerts pressure on the sectors in order to keep them firmly on one another;

the sectors are provided with a hooking/unhooking means positioned such that all of the sectors are hooked to one another from one sector to the next during closing of the hatch and are unhooked from one another from one sector to the next during opening of the hatch, at the junction between the horizontal movement section and the vertical stacking section;

the front ends of each sector are provided with a bevel made such that, when thrust is exerted in order to open the hatch, the bevel of the end of the adjacent sector (N−1) located across from the first sector (N) and the bevel of the corresponding end of the latter are made so as to cooperate so that the first sector (N) slides on the adjacent sector (N−1) and overlaps it, when the first sector (N) abuts in the vertical stacking section, said overlapping causing the unhooking of the two sectors (N, N−1) by implementing the hooking/unhooking means, said overlapping being followed by stacking of the two sectors on one another, that overlapping movement followed by stacking being done in the opposite order during closing of the hatch and being followed by the hooking of the two sectors, the same movement being done mutatis mutandis with the following adjacent sectors;

the access hatch has a rectangular-shaped opening and a sectional closing plate having a plurality of bellows able to slide in a translational movement and to be stacked in accordion-like fashion at one end of the hatch, during opening thereof;

the access hatch, the backplane and the slipring are assembled practically tightly and the vehicle is provided with means to ensure an overpressure in the inner space of the vehicle body, in order to ensure NBC protection for the crew;

the turret is an unmanned, remotely-operated turret provided with a cannon, an ammunition magazine, a radio and any other equipment, and the access hatch is designed to ensure access to that equipment through the inner volume of the turret;

the access hatch is positioned outside a central area occupied by the slipring so as to cover an access angle of up to 120 degrees in azimuth and to be able to move the turret in a movement between 0 and 90 degrees in the so-called "backup access" mode, so as to make it possible to straighten the turret in case of power failure, while ensuring ergonomics of the workspace;

the access hatch comprises at least one opening handle made from a flexible material;

the handle is made from synthetic fabric;

said backplane does not comprise parts penetrating an inner volume of said vehicle body lower than the lower part of the collecting ring.

According to aspects of the present invention shown in FIGS. 1 to 6, the access hatch 1, 10 is part of the backplane 3, which in turn is mounted on the base metal sheet of the turret via a circumferential rolling bearing. The hatch, which has the form of a circular sector or a rectangular shape, preferably goes up to 120 degrees in angular expanse and ensures a rotation of 90 degrees in backup mode. This access hatch 1, 10 allows easy access to the various equipment of the turret. A handle 12 of the access hatch 1, 10 is meant to be a flexible, non-rigid system so as to ensure the safety of the crew. It is for example made from synthetic fabric. The handle 12 can be provided on each side of the hatch so as to make it accessible indifferently from either side.

Advantageously, the hatch 1, 10, like the backplane 3, will be made from a material making it possible to guarantee a certain level of ballistic protection for the inside of the vehicle and its occupants, and defined based on the level of the final product.

For example, this protection will comprise a shielding metal covered with a spall-liner coating, preferably made from synthetic fibers such as Kevlar®, in order to ensure ballistic protection for the inside of the vehicle, and in particular for the crew.

According to a first embodiment of the invention shown in FIG. 1, an access hatch system 10 has been developed, in which the hatch has the form of a circular sector that will open and close owing to a rotational sliding movement 14 of a plate 11 having the same shape. The plate 11 slides inside the backplane in an opening 13 thereof for embedding, owing to rollers and arched rails (not shown) to facilitate its movement. This hatch 10 makes it possible, according to the very principle of the invention, to avoid an unnecessary or undesirable intrusion of the hatch into the vehicle body.

This system, however, has the drawback that the structure of the backplane 3 may be weakened relative to a usual structure, on the one hand due to the opening provided for the hatch strictly speaking and on the other hand due to the additional hollowed-out volume to be provided for sliding of the plate 11 when the hatch 10 opens and when the plate 11 "enters" the backplane 3. Another drawback of this embodiment is ergonomic: the inner convex part of the hatch does not allow access by a crew member other than that corresponding to a position facing the axis of the turret. A 90-degree rotation of the body is therefore not possible in this configuration.

Figure 2:
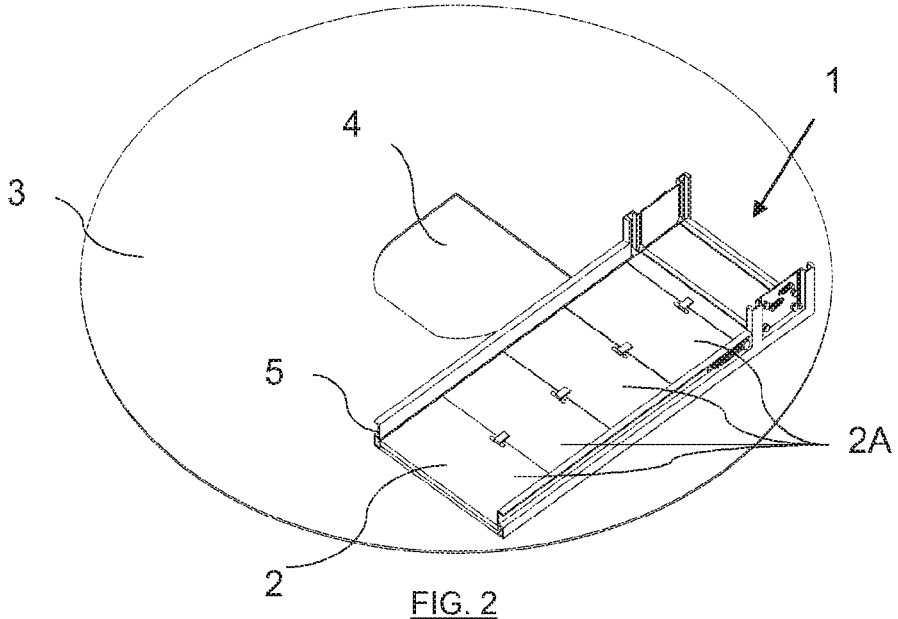
FIG. 2 diagrammatically, in perspective view, a second embodiment of the invention having an access hatch with a rectangular shape comprising a plurality of sliding and stackable sectors, the hatch being closed.
Figure 3:
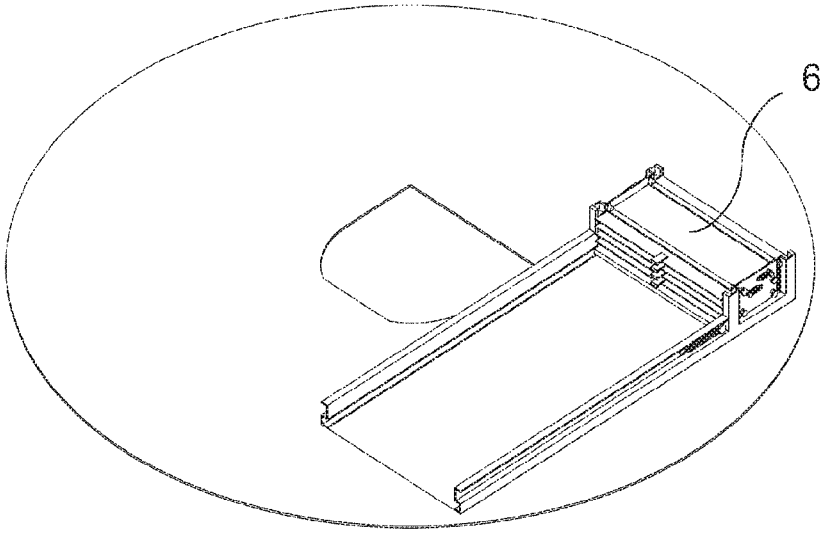
FIG. 3 diagrammatically, in perspective view, the second embodiment of the invention, the hatch being open.
Figure 4:
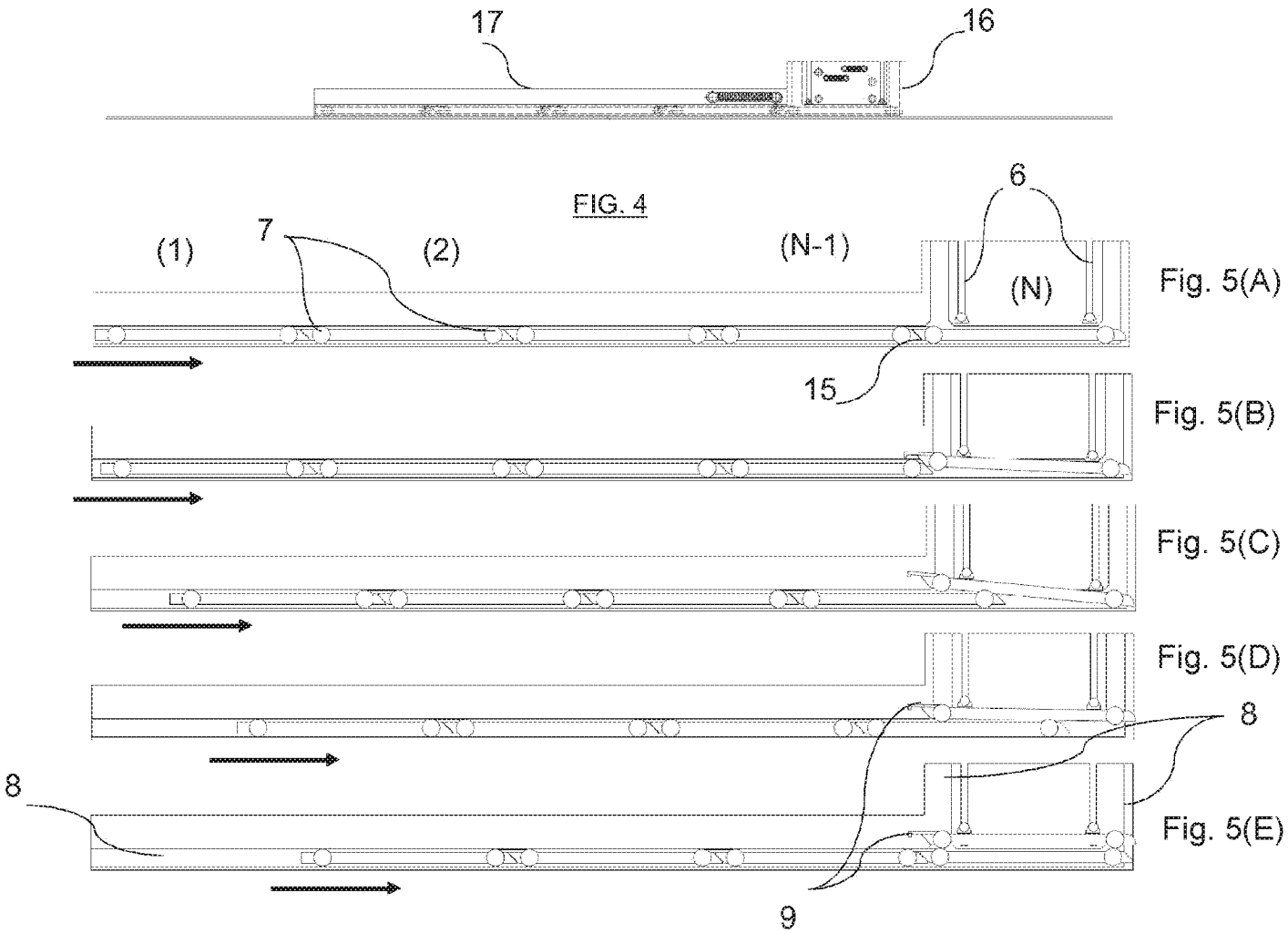
FIG. 4 a sectional view of the access hatch according to FIG. 2.
Figure 6:
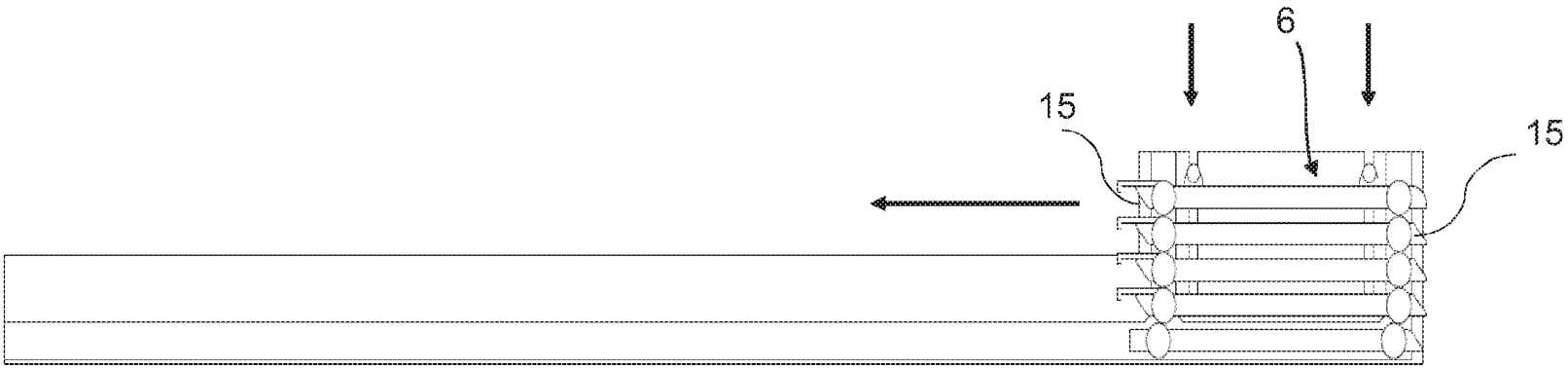
FIG. 6 a sectional view of the access hatch in the completely open position.

In order to offset the drawbacks of the first embodiment of the invention above, and in particular the weakening of the structure of the backplane, a second embodiment of the invention has been considered, as shown in FIGS. 2 to 4, in which the access hatch 1 comprises a plate 2 divided into several rectangular sectors 2A that are stacked during opening of the hatch (FIGS. 2 and 3). The correct stacking of the sectors 2A is ensured by a device 6 known by those skilled in the art, such as any device with jacks, springs, etc. that applies a downward force on the sectors in order to prevent the stacked sectors from leaving their location and therefore the guideways, in particular during rolling of the vehicle on uneven terrain.

The plates move, both when closing and opening the hatch, owing to rollers 7 moving in guides 5 having grooves that are horizontal on the one hand and vertical on the other hand (see FIG. 5). The sectors 2A provided with rollers can be compared to carriages. The latter are then hooked to one another owing to a hooking system (see below). The device 6 exerts thrust in the vertical grooves in order to guarantee correct stacking of the sectors 2A.

The use of rollers allows the sectors to slide in the guideways without the need for the operator to exert excessive force during opening or closing of the hatch. Any alternative solution making it possible to reduce the friction, such as the use of balls, rolls, bosses and metal-metal contacts, etc., of course falls within the scope of application of the present invention.

FIG. 5 shows an example of embodiment for the opening mechanism of the hatch 1. Initially, the hatch 1 is closed and the sectors 2A cover the entire opening of the hatch (FIG. 5A). They are attached to one another owing to the hooking/unhooking system 9, known by those skilled in the art, such as a system comprising a hook and an eyelet. The sectors 2A are hooked to one another from one sector to the next during the closing of the hatch and are unhooked from one sector to the next during the opening of the hatch, at the junction between the horizontal movement section 16 and the vertical stacking section 17, as described below.

The two front ends of each sector are provided with bevels 15, such that the bevels 15 of two adjacent sectors are made in a complementary manner to allow overlapping of the sectors on one another. Using the handle, the operator pushes the set of sectors to the right (see arrows in FIG. 5). When the first sector N abuts in the vertical stacking section 16, the continued thrust by the operator causes unhooking of the adjacent sector (N−1). The latter passes below the sector N, or in other words, the sector (N) overlaps the sector (N−1), in an oblique position (FIGS. 5B and 5C). When, in turn, the sector (N−1) abuts in the vertical stacking section (FIGS. 5D and 5E), the sector N−1 is completely straightened and is once again in the horizontal position. The pressure exerted by the device 6 keeps the two sectors (N) and (N−1) firmly against one another. If the thrust by the operator to the right using the handle continues, the sectors 2A will thus be stacked from one sector to the next in the vertical section 16 until all of the carriages are located in that section. At that time, the hatch 1 is completely open (see FIG. 6).

The inverse movement of the sectors 2A occurs when the operator exerts a traction on the handle, the hatch 1 being completely open. The last sector (1) having arrived in the vertical section and that is located at the bottom of the stack will gradually be released from the next-to-last sector (2), the latter tilting, still under the thrust of the device 6. The end of the next-to-last sector (2) furthest to the left slides on the end furthest to the right of the last sector (1) until the latter is released from the vertical section 16 completely and is fully engaged in the horizontal movement section 17. At that time, when the sector (2) falls next to the sector (1) by sliding of the bevels 15, the hooking of the two sectors occurs by means of the hooking system 9. If the traction by the operator continues, all of the sectors are released in turn and are hooked to one another from one sector to the next, until the hatch 1 is completely closed. The unhooking of the sectors from one sector to the next is of course done in the opposite manner during opening of the hatch.

According to a third embodiment of the invention, the access hatch will have a rectangular-shaped opening and a sectional closing plate having a plurality of bellows able to slide in a translational movement and be stacked in accordion-like fashion at one end of the hatch, during opening thereof. This solution has the advantage of having to overcome less friction during the opening of the hatch than in the previous solution, but it nevertheless has the drawback of requiring a space with a greater height to house the hatch in the backplane.

The hatch of the turret, whether in the form of a circular or rectangular sector, will be advantageously positioned in order to allow easy access to the systems of the turret. It will be situated so as to avoid any intrusion into the vehicle body from the turret while allowing access both to the front and to the rear of the turret, from the body of the vehicle.

In particular, the hatch will be positioned so as to cover an access angle of up to 120 degrees and to be able to move the turret by a movement between 0 and 90 degrees in azimuth in the so-called "backup access" mode, so as to make it possible to straighten the turret in case of power failure, while ensuring perfect ergonomics of the workspace.

Although the present invention has been described using a detailed description, in which different embodiments have been explained, one skilled in the art will see that the scope of the present invention is in no way limited to those embodiments stated above. The invention has a scope proportional to the claims of the present application, including all aspects or elements that could be considered to be equivalent to those stated in the main or dependent claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LEGEND

1. rectangular access hatch system
2. plate made in several rectangular sectors
2A. individual sector
3. backplane
4. slipring assembly area
5. guide with grooves
6. device for ensuring stacked rectangular sectors

7. roller
8. groove in the guide
9. hooking system
10. access hatch system with circular sector
11. plate with a single circular sector
12. handle
13. opening in the backplane for embedding the plate 11
14. rotational sliding movement
15. bevel
16. vertical stacking section
17. horizontal movement section
18. backplane ring
19. front of the turret
20. rear of the turret

The invention claimed is:

1. An armored vehicle, comprising:

a vehicle body; and a turret mounted so as to be rotatable along a substantially vertical axis on the vehicle body using a circumferential rolling bearing, wherein the turret includes a base in a form of a backplane, connected to the vehicle body by the circumferential rolling bearing, wherein the backplane includes a collecting ring in a form of a slipring, configured to convey energy and electric signals to control the turret, wherein the backplane includes an access hatch mounted slidingly in the backplane and allowing access to an inner volume of the turret from an inner volume of the vehicle body, wherein the access hatch has a rectangular-shaped opening and includes a plate configured to close up the rectangular-shaped opening, the plate having a form of a plurality of sectors able first to slide in a translational movement in a horizontal movement section and able to be stacked on one another in a vertical stacking sections, wherein, during opening of the hatch, the sections are located superimposed in or above the backplane, and wherein the access hatch sectors and the backplane include ballistic protection in a form of a metal armor plate covered with an anti-spall coating.

2. The armored vehicle of claim 1, wherein the access hatch includes guides including grooves belonging to the horizontal section, in which the sectors slide and belonging to the vertical section in which the sectors are stacked on one another, and wherein the sectors include rollers cooperating with the grooves of the guides to ensure the movement of the sectors in the horizontal section and in the vertical section, respectively.

3. The armored vehicle of claim 2, wherein the vertical section includes a pressure exerter, configured to exert pressure on the sectors in order to keep them firmly on one another.

4. The armored vehicle of claim 1, wherein the sectors include a hooking/unhooking unit positioned such that all of the sectors are hooked to one another from one sector to the next during closing of the hatch and are unhooked from one another from one sector to the next during opening of the hatch, at a junction between the horizontal movement section and the vertical stacking section.

5. The armored vehicle of claim 1, wherein front ends of each sector including a bevel configured such that, when thrust, is exerted in order to open the hatch, the bevel of an end of an adjacent sector (N−1) located across from a first sector (N) and the bevel of a corresponding end of the latter are made so as to cooperate so that the first sector (N) slides on the adjacent sector (N−1) and overlaps it, wherein, when the first sector (N) abuts in the vertical stacking section, the overlapping causes unhooking of the two sectors (N, N−1) by implementing the hooking/unhooking unit, wherein the overlapping is followed by stacking of the two sectors on one another, wherein an overlapping movement followed by stacking is done in the opposite order during closing of the hatch and is followed by hooking of the two sectors, a corresponding same movement being done with following adjacent sectors.

6. The armored vehicle of claim 1, comprising a sectional closing plate including, as the sectors, a plurality of bellows able to slide in a translational movement and to be stacked in accordion-like fashion at one end of the hatch, during opening thereof.

7. The armored vehicle of claim 1, wherein the access hatch, backplane, and slipring are assembled practically tightly, and wherein the vehicle or tank includes a pressure unit configured to ensure an overpressure in the inner space of the vehicle body, in order to ensure NBC protection for the crew.

8. The armored vehicle of claim 1, wherein the turret is an unmanned, remotely-operated turret including a cannon, an ammunition magazine, and a radio, and wherein the access hatch configured to ensure access to turret contents through an inner volume of the turret.

9. The armored vehicle of claim 8, wherein the access hatch is positioned outside a central area occupied by the slipring so as to cover an access angle of up to 120 degrees in azimuth and to be able to move the turret in a movement between 0 and 90 degrees in so-called "backup access" mode, so as to make it possible to straighten the turret in case of power failure, while ensuring workspace ergonomics.

10. The armored vehicle of claim 8, wherein the access hatch includes an opening handle including a flexible material.

11. The armored vehicle of claim 10, wherein the handle is made from synthetic fabric.

12. The armored vehicle of claim 1, wherein the backplane includes no parts penetrating an inner volume of the vehicle body lower than a lower part of the collecting ring.

* * * * *